United States Patent [19]

Hodgkinson

[11] 4,077,269

[45] Mar. 7, 1978

[54] VARIABLE DISPLACEMENT AND/OR VARIABLE COMPRESSION RATIO PISTON ENGINE

[75] Inventor: Robert Hodgkinson, San Diego, Calif.

[73] Assignee: Lang Research Corporation, Suisun, Calif.

[21] Appl. No.: 661,550

[22] Filed: Feb. 26, 1976

[51] Int. Cl.[2] ..... F16H 23/00; F04B 1/12; F01B 1/06

[52] U.S. Cl. ..... 74/60; 92/12.1; 417/269

[58] Field of Search ..... 91/505; 417/269; 74/60; 123/78 F, 48 B, 58 B; 92/12.1

[56] References Cited

U.S. PATENT DOCUMENTS

| | | | |
|---|---|---|---|
| 1,825,691 | 10/1931 | Hall | 74/60 |
| 2,532,254 | 11/1950 | Bouchard | 74/60 |
| 2,644,021 | 6/1953 | Hittell | 123/48 B |
| 2,964,234 | 12/1960 | Loomis | 74/60 |

FOREIGN PATENT DOCUMENTS

| | | | |
|---|---|---|---|
| 2,345,225 | 3/1975 | Germany | 123/48 B |
| 252,225 | 5/1926 | United Kingdom | 123/48 B |

*Primary Examiner*—William L. Freeh
*Attorney, Agent, or Firm*—Edward B. Gregg

[57] ABSTRACT

Variable displacement and/or variable compression ratio reciprocating piston engine, for example, an internal combustion engine, having piston and drive shaft essentially parallel to one another with a swash plate mounted on the drive shaft and a connection between the piston and the swash plate. The mounting of the swash plate permits variation of the angle to the drive shaft to vary the piston stroke and also permits movement of the swash plate along the axis of the drive shaft to exercise control over the compression ratio.

12 Claims, 11 Drawing Figures

FIG. 4
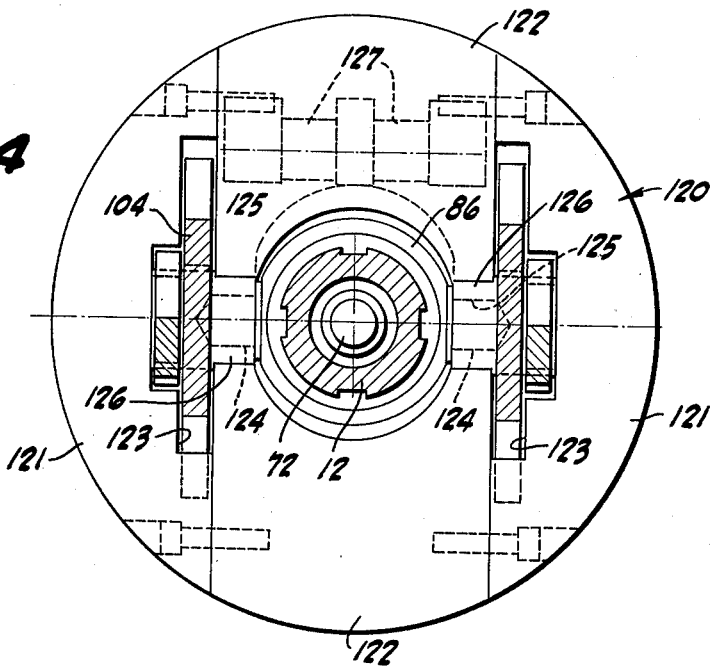
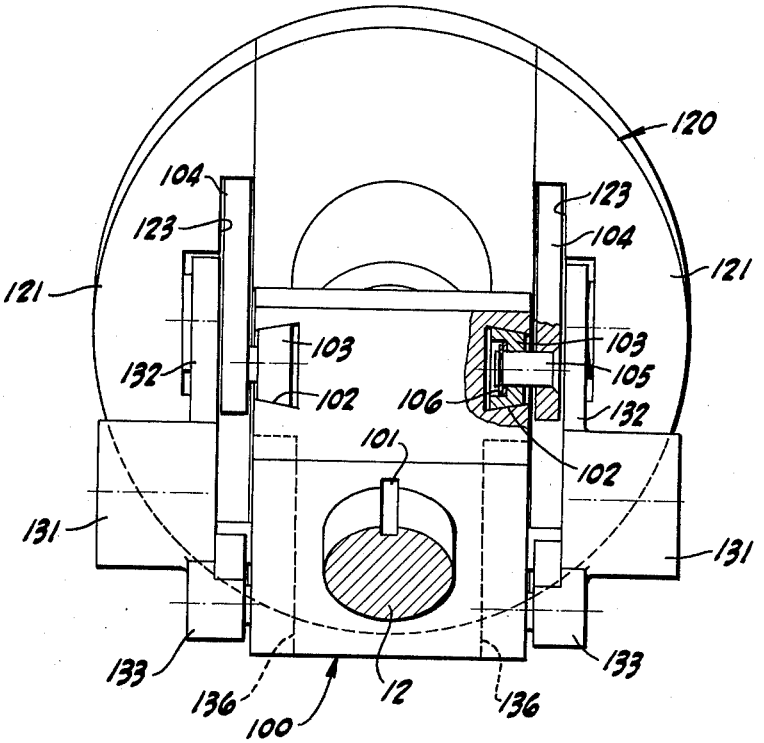
FIG. 5

VARIABLE DISPLACEMENT AND/OR VARIABLE COMPRESSION RATIO PISTON ENGINE

This invention relates to variable displacement and/or variable compression ratio reciprocating piston machines. The invention is applicable to any engine or machine wherein there is a driving or driven shaft (hereinafter called a "drive shaft") and one or more cylinders essentially parallel to the drive shaft, a piston in the cylinder and means connecting the piston with the drive shaft such that reciprocating motion of the piston is translated into rotary motion with the drive shaft and vice versa. The engine may be an internal combustion engine operating on a fuel such as gasoline, diesel fuel, natural gas, butane, propane or any other combustible fuel; it may be an external combustion engine such as the Stirling engine; or it may be a pump or compressor in which the pistons are operated by the drive shaft.

The theoretical advantages of variable displacement engines are well-known. For example when an engine is operating under conditions requiring substantially less than its full power potential as in a motor car travelling along a level smooth highway at a constant speed, the ability to diminish the displacement is advantageous.

Several designs of variable displacement engines have been proposed. One such design employs a wobble plate mounted on the drive shaft in such a manner that its angle in relation to the axis of the drive shaft is variable and the position of the wobble plate along the axis of the drive is varied by a splined connection between parts of the drive shaft such that the part on which the wobble plate is mounted can be caused to move axially in relation to the other part of the drive shaft.

Such designs have been disadvantageous in one or more respects, such as requiring excessive size of the engine, difficulty in manufacturing and/or assembling the components of the engine, inefficiency or lack of sturdiness and resistance to a breakdown due to the forces acting on the engine during its operation.

It is an object of the present invention to provide variable displacement engine of improved design.

It is a particular object of the invention to provide a variable displacement piston engine in which the components are more economically or easily fabricated.

Another object of the invention is to provide a variable displacement piston engine which does not involve unacceptable or excessive dimensions.

Yet another object is to provide a variable displacement reciprocating piston engine which is capable of operating efficiently and withstanding the forces which are imposed upon it during operation.

The above and other objects of the invention will be apparent from the ensuing description and the appended claims.

Certain embodiments of the invention are shown by way of example in the accompanying drawings in which:

FIG. 4 is a view taken along the line 4—4 of FIG. 3B showing the manner in which the balance plate is mounted.

FIG. 5 is a view taken along the line 5—5 of FIG. 3A showing the cam structure for controlling the angle of the swash plate.

Figure 1:
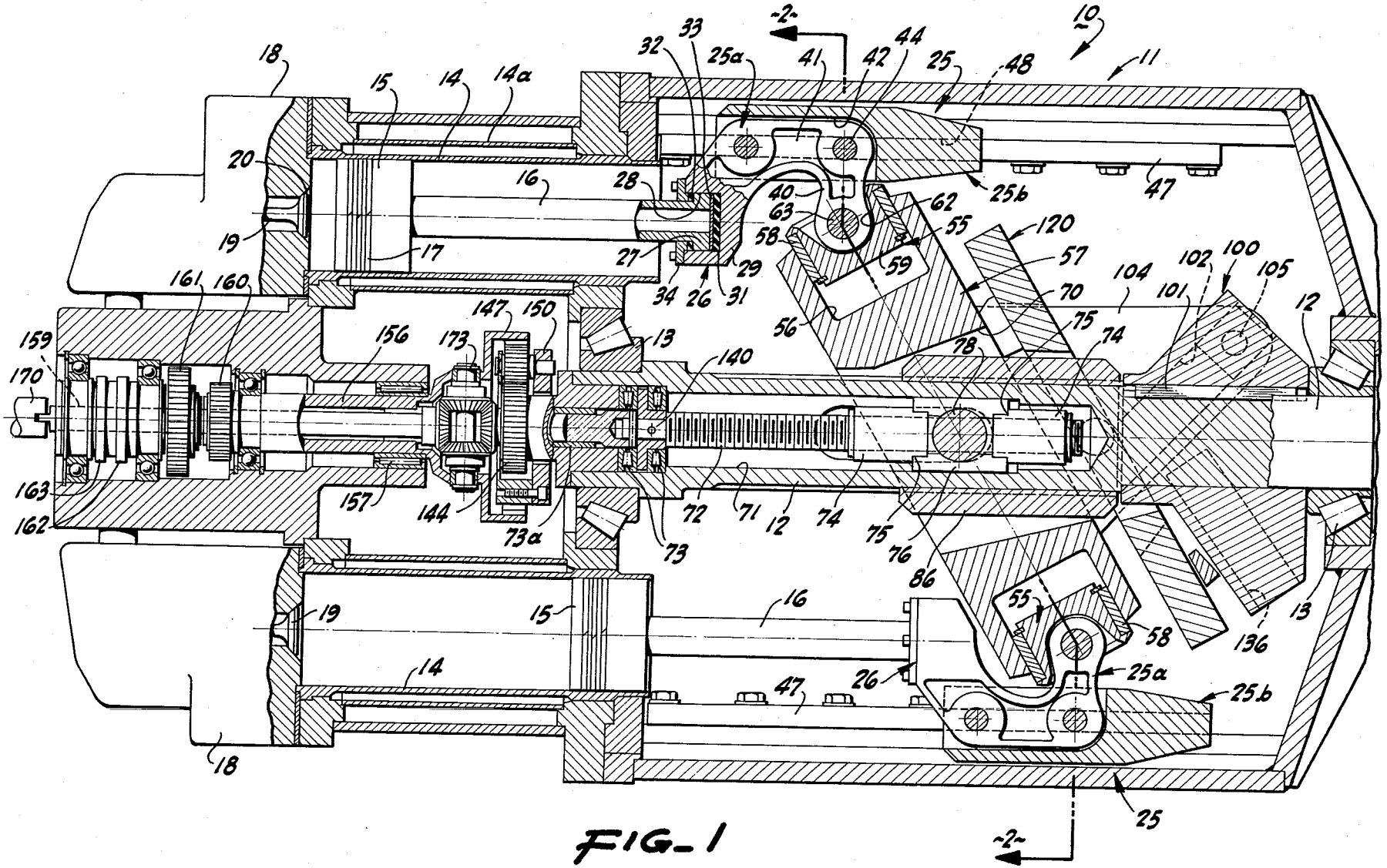
FIG. 1 is a vertical midsection taken through the engine which is shown as horizontal but which may be vertical.

In the drawings, a spark ignition gasoline engine is shown which is of the internal combustion type and it is shown as having seven cylinders. It will be understood, however, that the engine may be fueled by other fuels, such as for example natural gas, butane or propane, or by diesel fuel; that it may be a compression ignition (diesel) engine rather than a spark ignition engine; that it may be an external combustion engine such as the Stirling engine or a steam engine; and that it may be a pump or a compressor in which the power input is through the drive shaft and the pistons are operated for purposes of pumping and/or compressing a fluid.

Figure 2:
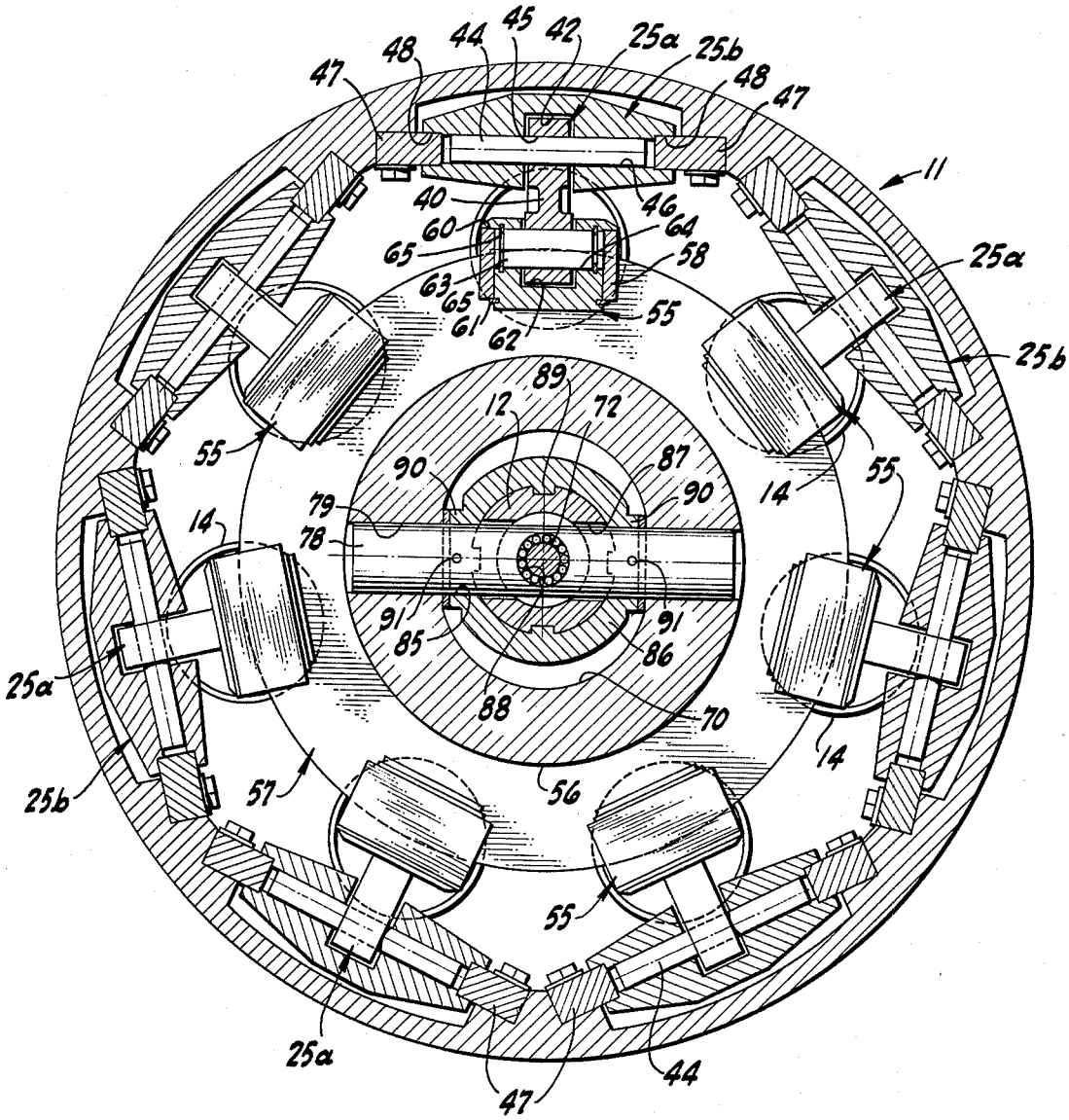
FIG. 2 is a staggered section taken along the line 2—2 of FIG. 2.

Referring now more particularly to FIGS. 1 and 2, the engine is of the barrel type and is generally designated by the reference numeral 10. It comprises a frame 11 and a central drive shaft 12 supported in main bearings 13. Cylinders 14 are provided each with a cooling jacket **14*a*. Inasmuch as each of the cylinders and pistons is identical to the others only one of them (that shown in the upper left hand portion of FIG. 1) and the means for connecting the same to the swash plate will be described. As will be seen in FIG. 2**, the engine shown is a seven cylinder engine but more or fewer cylinders may be employed. The engine described is of the four cycle type and for that reason an odd number of cylinders is employed. However, for a two cycle engine an odd or even number of cylinders may be employed. The cylinders are arranged equi-angularly about and concentrically to the drive shaft. The cylinders and their piston rods are shown as parallel to the drive shaft but they may depart slightly from parallelism.

A piston 15 is reciprocable within each of the cylinders and is provided with a piston rod 16 which is shown as being hollow to reduce weight. The piston is provided with conventional rings 17. The cylinder head 18 is provided with appropriate valves, one of which is shown at 19 seated on its valve seat 20. There is an intake valve for intake of a mixture of fuel (e.g. gasoline) and air and an exhaust valve for each cylinder.

The cylinder at the upper left of FIG. 1 is shown at the top of its stroke and as leaving a clearance space $V_1$ whereas the cylinder at the bottom of FIG. 1 is shown at the bottom of its stroke and as leaving a space $V_2$ in the cylinder. The object of the mechanism described hereinafter is to vary the stroke of the piston and thereby vary the displacement $(V_2 - V_1)$ and to control the compression ratio $V_2/V_1$ either by way of varying it as desired or holding it constant. In the case of a diesel engine, the stroke may remain constant and only the compression ratio varied.

The piston rod at its outer end is connected to a cross-head 25 formed by two parts 25*a* and 25*b*. The part 25*a* is connected to the piston rod by means generally designated as 26. A similar structure (not shown) is employed to connect the inner end of the piston rod to the piston. Thus, the usual wrist pins are not employed although if desired they may be used. The preferred connecting means which will now be described.

The structure 26 includes a flange 27 on the outer end of the piston rod which is received in a socket 28 formed in one leg 29 of the cross head member 25*a* which is in the form of a U-shaped bracket. To secure the flange tightly in place but to allow flexing in response to lateral forces caused by misalignment, a silicone rubber or other suitable heat resistant, flexible material is provided at 31 and 32 together with a metal (e.g. aluminum) disk 33 to prevent extrusion of the flexible material into the piston rod cavity. A retainer ring 34 is bolted to the leg 29 of bracket 25*a*.

The bracket 25*a* has another leg 40 connected to leg 29 by a connecting portion 41 which is seated in a vertical slot 42 formed in the second cross head member or slide 25*b*. Two pins 44 extend through passages 45 in the cross head and passages 46 in the slide to hold the two parts (the bracket 25*a* and the slide 25*b* ) together. Gibs 47 bolted to the frame on opposite sides of the slide are received in slots 48 formed in the slide 25*b* whereby reciprocating motion of the piston causes similar movement of the slide and cross head. Slight flexing of the piston rod 16 due to lateral forces is accommodated by the flexible pads 31 and 32. The two part construction of cross head 25 and the two pins 44 have an advantage. If the cross head 25 were made in one piece forces acting on it would stretch the legs 29 and 40 apart and would deform slots 48 which would cause them to bind on gibs 47. The construction shown prevents this.

The leg 40 of bracket 25*a* is connected to a slipper block 55 which is slideable in a circumferential groove 56 formed in a swash plate 57. The swash plate 57 is mounted by means described below on the drive shaft 12 and it serves to translate reciprocating motion of the pistons to rotary motion of the drive shaft. (In a pump or compressor, the swash plate would, of course, translate rotary motion of the drive shaft into reciprocating motion of the pistons.) Slipper block 55 comprises a squarehousing 58 slideable radially as well as circumferentially in groove 56, and a cylindrical pivot block 59. The latter is held in place in its housing by a shoulder 60 and a keeper ring 61. The pivot block is formed with a socket 62 in which is located a pin 63 which is rotatable in passage 64 in the lower end of the leg 40 of the bracket 25*a*. As shown in FIG. 2, pin 63 is held in place by two keeper rings 65. Rings 65 are expansible-compressible rings which, when expanded, are received in grooves in the shoulder and block. As each piston 15 reciprocates in its cylinder 14, the swash plate 57 will rotate. The groove 56 will move in succession about each of the slipper blocks 55, thereby causing the drive shaft 12 to rotate about its axis. The slipper blocks are free to slide circumferentially and radially in the groove 56 of the swash plate.

The swash plate 57 has the shape in cross section through a diameter as shown in FIG. 1, although other shapes may be employed. It is formed with a large central opening 70 through which the drive shaft 12 passes. The drive shaft is formed with an axial passage 71 within which is located a control screw 72 which is coaxial to the drive shaft and which is secured thereto by means presently to be described so as to rotate therewith in the same direction and at the same speed as the drive shaft. At its left hand end, as viewed in FIG. 1, the control screw 72 is supported by thrust bearings 73 and needle bearing 73a. Two nuts 74 are provided which are threaded onto the control screw. The threaded engagement is preferably of that of a ball screw but any other suitable form of screw thread may be used. Each nut 74 is formed with a shoulder 75 so that its end of reduced diameter fits into and is threaded into a trunnion block 76. The block 76 is slideable in the axial passage 71 of the drive shaft 12 but it is held against rotational movement relative to shaft 12 by means of a pin 78. The pin 78 is located in passages 79 aligned on a diameter in the swash plate; it passes through aligned passages 85 in a torque sleeve 86 and through aligned slots 87 in the drive shaft 12. Pin 78 is formed with a smooth, unthreaded passage 88 through which the control screw 72 passes. Torque sleeve 86 is splined to the drive shaft 12 as shown in 89 in FIG. 2. The torque sleeve 86 is formed with bosses 90. Pins 91 pass through these bosses and through the pin 78 to hold the pin in place.

It will be apparent that as the pistons 15 reciprocate in the cylinders 14, the swash plate guide, will be caused to rotate and it will, in turn, rotate the drive shaft 12 thereby supplying power to the drive shaft for operating the vehicle. It will also be apparent that the stroke of each piston 15 will be determined by the angle of the swash plate. Assuming a horizontal engine, the further the angle of the swash plate 57 departs from the perpendicular, the greater will be the piston stroke and vice versa. This angle is controlled by rotation of the control screw 72 and by an associated cam assembly which will be described shortly. The control screw 72, as will become apparent, will normally be at rest with relation to the drive shaft so that the swash plate will maintain a fixed position on the drive shaft during steady state operation. It will also be apparent that if the control screw 72 is rotated relatively to the drive shaft 12, that is to say, if its speed of rotation is speeded up or slowed down in relation to the drive shaft by turning the screw 72 in one direction or the other, the swash plate 57 will be moved to the left or to the right according to the direction of turning of the control screw.

Figure 9:
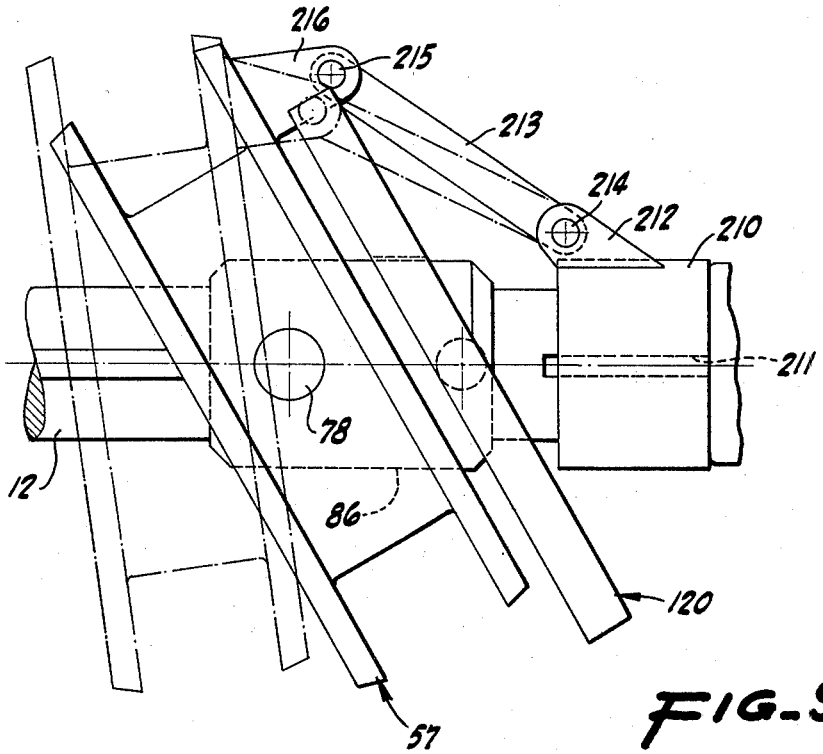
FIG. 9 is a view in side elevation of a link connection between the swash plate and the drive shaft instead of a cam connection whereby the angle of the swash plate is varied as it is moved axially along the drive shaft.

For the purpose of varying the angle of the swash plate and thereby varying the displacement in the cylinders, a cam assembly is provided which is shown in FIGS. 1, 3A, 3B and 5. This cam assembly comprises a cam block 100 which is keyed at 101 to the drive shaft. It is removable from the drive shaft for replacement by another cam block having a different design for accomplishing a different purpose as will become apparent hereinafter. An alternative to this cam assembly is shown in FIG. 9 and will be described later in connection with that Figure.

The cam block 100 is formed with dovetail grooves 102, one on each side (see FIG. 5) within which cam followers 103 of similar shape are seated and in which they may slide. Each cam follower 103 is connected to one end of the arm 104 by a pin 105 which is held in place by a keeper ring 106 and is freely rotatable in its cam follower 103 or in its arm 104 or in both. The dovetail shapes of the cam grooves 102 and cam followers 103 resist forces that would otherwise tend to spread the cam followers apart and dislodge them from the cam grooves. At its other end, each arm 104 is secured as by welding to a side of the swash plate 57.

It will be apparent that as the control screw is given an increment of rotary movement relative to the drive shaft 12, the nuts 74 and trunnion block 76 will be moved forward (to the left as viewed in FIG. 9) or rearward (to the right as viewed in FIG. 1) and will, accordingly, shift the swash plate along the drive shaft. Such motion will cause the cam followers 103 to move up or down the cam tracks 102 according to the direction of rotation of the control screw 72. As will be seen, the cam grooves are at an angle to the axis of the drive shaft and as the followers 103 move down the cam tracks 102 the effect will be to rotate the swash plate about the axis of the pin 78 toward the vertical. As the followers 103 move up the cam tracks 102, the swash plate will be moved away from the vertical. It will be apparent that by this means the piston stroke and therefore the displacement are varied. The cam assembly is also provided with a counterbalance which is described below.

The cam assembly will also serve to control the compression ratio and will maintain the compression ratio constant or will vary the compression ratio in a predetermined manner according to the design of the cam tracks 102. With linear cam tracks as shown, as the stroke is diminished by moving the swash plate more nearly to the vertical, the relation of $V_1$ to $V_2$ will vary, for example from a value of 13:1 at minimum stroke to 8:1 at maximum stroke. By appropriate design of the cam tracks 102 it is possible to maintain the compression ratio constant or to vary it according to the piston stroke.

The swash plate 57 serves not only the purposes described above (that is, translating reciprocating motions of the pistons to rotary motion of the drive shaft, variation of displacement and control of compression ratio) but it also serves as a counterbalance to counter balance reciprocating forces. However, the effective mass of the swash plate for this purpose is a function not only of its weight but also of the angle it assumes in relation to the drive shaft. To compensate for these variations, and to provide at all times and under all conditions a proper counterbalancing mass, a balance plate 120 is provided.

The balance plate 120 is formed in four parts for ease of assembly and it consists of two side segments 121 and two center segments 122 which are bolted together as shown, and are formed with openings 123 to clear arms 104 which connect the swash plate 57 to the cam followers 103. Aligned pins 124 fixed to the torque sleeve are received in sockets 125 in tongues 126 of side segments at 121 so that the plate 120 may pivot about the axis of the pins 124. A pair of links 127 above the drive shaft are provided each of which is mounted at one end on a pin 128 fixed to a boss 129 on plate 120 and at its other end on a pin 130 fixed to the swash plate.

Figure 3A:
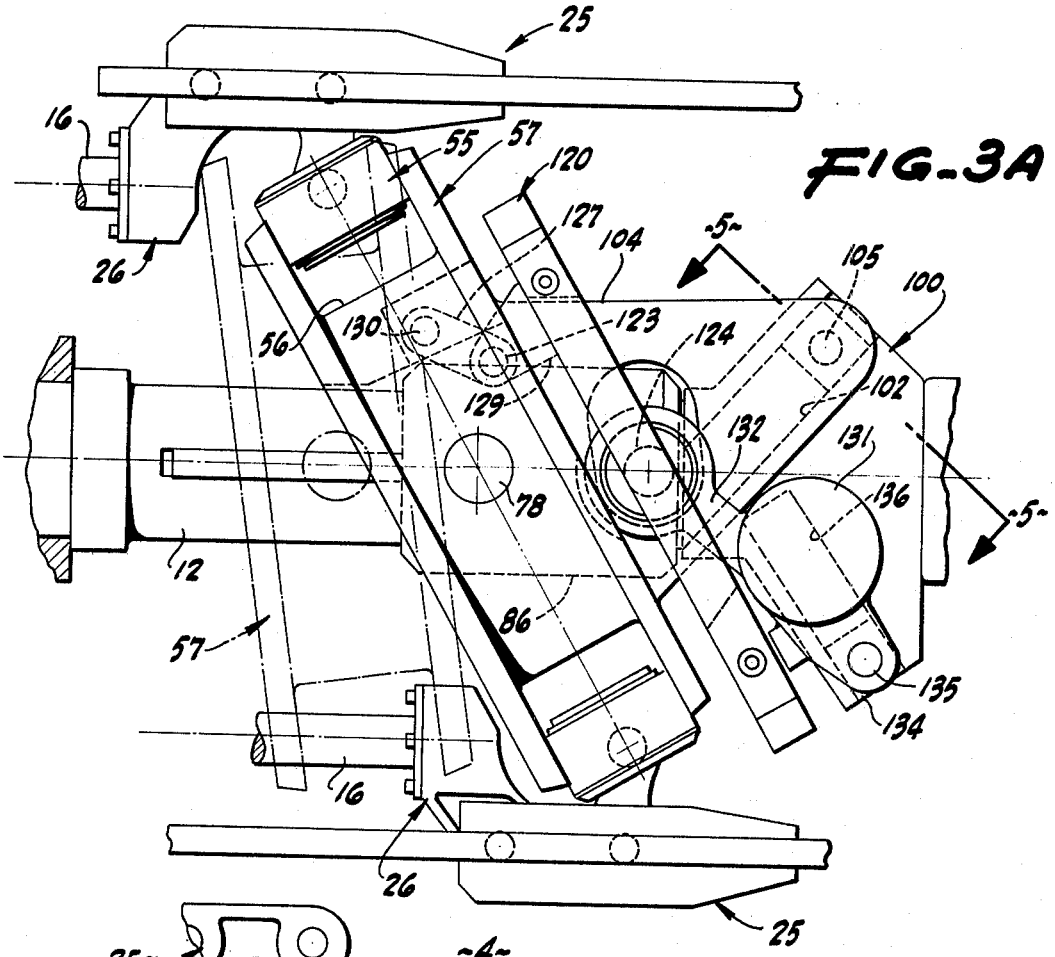
FIG. 3A is a fragmentary view in side elevation showing the manner of mounting the swash plate on the drive shaft and showing the swash plate in solid line in one angular position in relation to the drive shaft and in broken line in another angular relationship to the drive shaft.

Looking at FIG. 3A, the swash plate is shown in full line in a position relatively far from the vertical, corresponding to a longer piston stroke, and the cam followers 103 are shown as being located higher up in the cam grooves 102. As the control screw 72 is operated to move the swash plate 57 forwardly or to the left as viewed in FIG. 3A, the cam structure will, as described above, operate to tilt the swash plate to an angle closer to the vertical, as shown in broken lines in FIG. 3A.

Figure 3B:
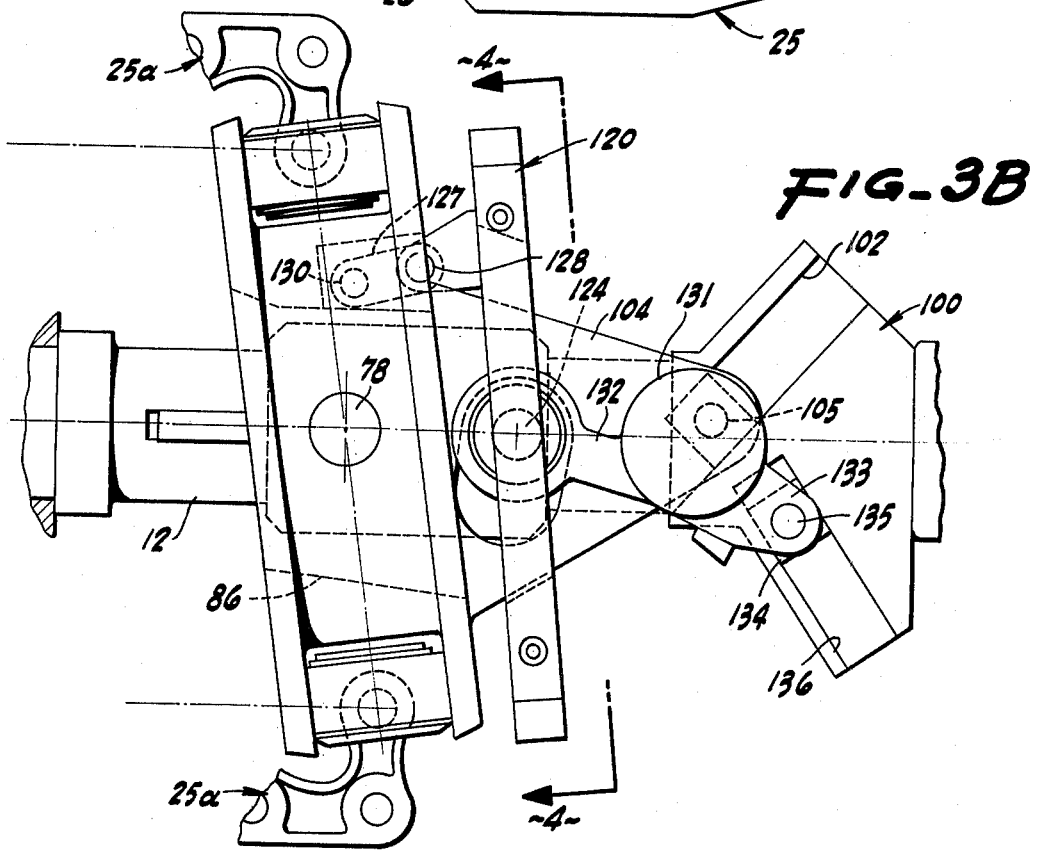
FIG. 3B is a view similar to FIG. 3A but showing the balance plate in a different position to maintain the proper effective mass opposing the reciprocating forces.

Looking now at FIG. 3B in which the more nearly vertical swash plate is shown in full line, it will be seen by comparison with FIG. 3A that the angle of the balance plate 120 in relation to the swash plate 57 is altered. The design is such that the moments of the swash plate and the balance plate match the reciprocating moments at all angles of the swash plate.

Figure 6:
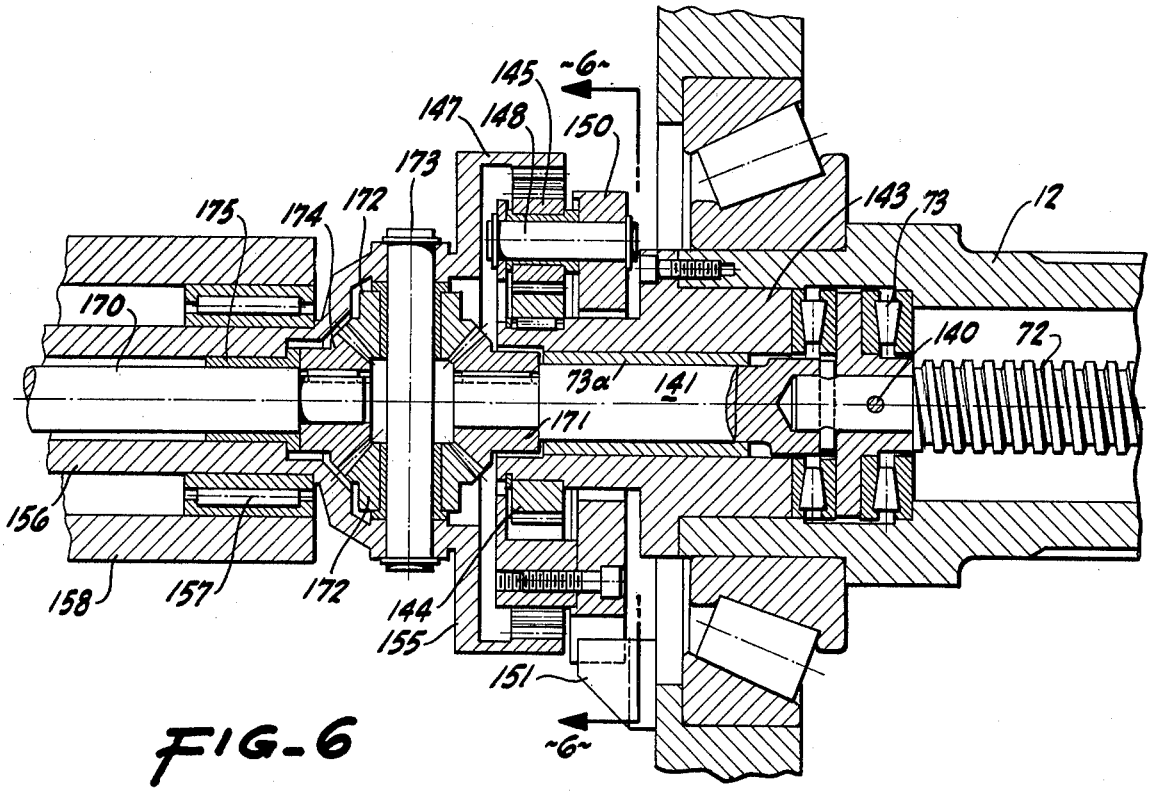
FIG. 6 is a vertical midsection taken through the forward end of the drive shaft and showing the means whereby the control shaft is rotated relatively to the drive shaft to adjust the position of the swash plate on the drive shaft.
Figure 7:
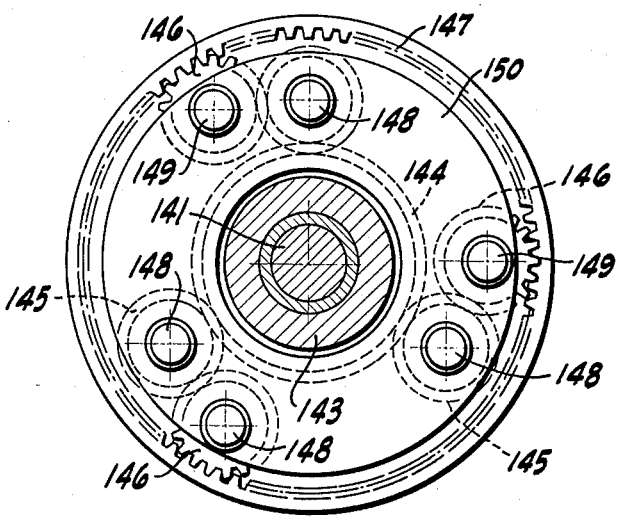
FIG. 7 is a view taken along the line 7-7 of FIG. 6.

Referring now to FIGS. 1, 6 and 7, the left-hand end of control screw 72 is pinned at 140 to an extension 141 supported in bearing 73a. An extension 143 is bolted to the drive shaft 12, and to the left-hand end of the extension 143 is keyed a sun gear 144. The sun gear 144 is geared by planet gears 145 and 146 to a ring gear 147. Planet gears 145 and 146 are rotatable on pins 148 and 149 carried by a stationary plate 150 which is held stationary by a tie 151 to the frame of the engine. Ring gear 147 is integral with or is suitably connected to a housing 155 which, in turn, is integral with or is affixed to hollow shaft 156 supported by bearings 157 in frame member 158. Shaft 156 is geared to a cam shaft 159 by gears 160 and 161 which are connected by a lay shaft and idler gears (not shown) so that the cam shaft will rotate in the proper direction and at the proper speed so as to operate cams 162 and 163 which, in turn, operate the intake and exhaust valves of the engine in a manner which is well known in radial engines and requires no further description herein.

The housing 155, in addition to providing a part of the drive for the cam shaft 159, serves also to house a differential gear structure which serves to transmit rotation of a control shaft 170 to the control screw 72, that is, to turn the control screw in one direction or another relative to the drive shaft 12 and thereby adjust the position of the swash plate 57 on and it angle to the drive shaft 12. This differential gearing consists of a mitre gear 171 keyed to the left-hand end of shaft 141, a pair of mitre gears 172 meshing with the gear 171 and rotatable on a pin 173 supported by the housing and a mitre gear 174 which is keyed to the adjacent end of control shaft 170. The control shaft 170 is mounted in a bearing 175 so as not to rotate with the shaft 156. The presence of two mitre gears 172 at opposite ends of pin 173 is for purpose of balancing and even load distribution.

The gear ratio and the arrangement of gears between the drive shaft extension 143 and cam shaft 156 are typically such that the ring gear 147 rotates in the same direction as and at half the speed of the drive shaft 12. The control shaft 170 remains stationary during a steady operation, being held stationary by a control motor (electric or hydraulic) driving through a worm and worm gear. Alternatively, the operating means for the control shaft may be from the drive shaft 12 by means of a series of controlled clutches. Such operating means are well known and require no further description other than as set forth below in connection with FIG. 8. When the control shaft 170 is rotated in one direction or the other, it rotates the mitre gear 174 and that motion is transmitted through the gears 172 to the gear 171, the shaft 141 and the control screw 72, thereby speeding up or slowing down the rotation of the control screw in relation to the drive shaft and accomplishing movement of the swash plate as described above.

Figure 8:
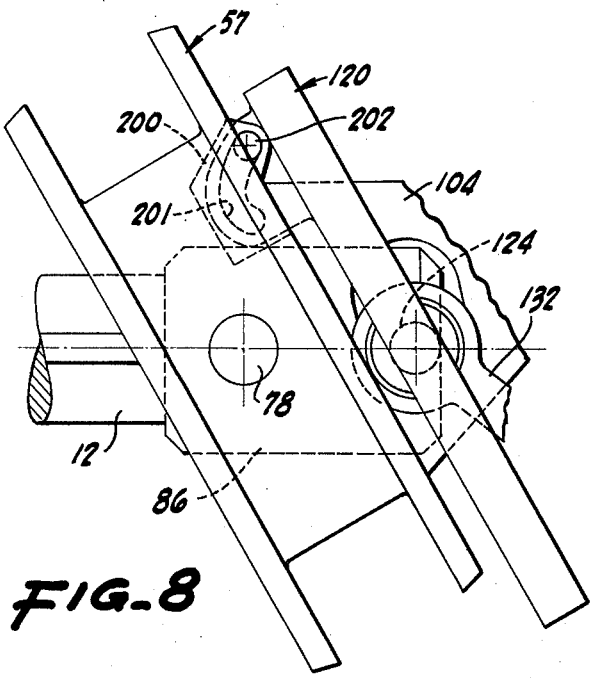
FIG. 8 is a view in side elevation showing a more accurate but more expensive connection (a cam instead of a link connection) between the balance plate and the swash plate.

Referring now to FIG. 8, an alternative linkage between balance plate 120 and swash plate 57 is shown which comprises a bracket 200 fixed to each side of the plate 120 (one such bracket being shown) in which a curved cam groove 201 is formed and in which a cam follower 202 mounted on the swash plate moves. As the angle of the swash plate varies, the cam followers 202 will move in the grooves 201 and will adjust the angle of the balance plate 120. An advantage of this cam linkage is that a more precise and accurate adjustment of the balance plate 120 in relation to the swash plate 57 is made possible than with the link structure shown in FIGS. 3A and 3B. However, because the grooves 201 are not circular and require machining, it is more expensive than the links of FIGS. 3A and 3B.

Referring now to FIG. 9, an alternative to the cam assembly shown in FIGS. 3A, 3B and 5 is illustrated. A sleeve 210 is keyed at 211 to the drive shaft 12, and it has a bracket 212 on which a link 213 is pivoted at 214. There are two such brackets and links, one on each side, only one of which is shown. The other end of the link 213 is pivoted at 215 on a bracket 216 fixed to the swash plate 57. As will be seen from the full line and broken line views of the link 213 and swash plate 57, the angle of the swash plate in relation to the drive shaft varies as the position of the swash plate on the drive shaft varies. By appropriate design, the links are caused to vary the angle of the swash plate to accomplish the same result as the cam block 100 shown in FIGS. 3A, 3B and 5.

A variable factor which, if not compensated or matched, is the fact that as the angle of the arms 104 and associated parts varies in relation to the axis of the drive shaft, these moments will also vary. To compensate for this variable, a counterbalance is provided in the form (see FIGS. 3A and 3B) of weights 131 (one of which is shown, the other being on the other side of the drive shaft) carried by arms 132 pivoted on the pins 124 which support the balance plate 120. To each weight 131 is fixed a bracket 133 which supports a cam follower 134 mounted on a pin 135. The cam follower 134 moves in cam grooves 136 formed in cam block 100. As will be seen by comparison of FIGS. 3A and 3B, as the angle of the swash plate 57 varies, so will the position of the weights 131. The design of the cam tracks 136 and of the weights 131 is such that they will compensate for or match the variable mentioned above.

Figure 10:
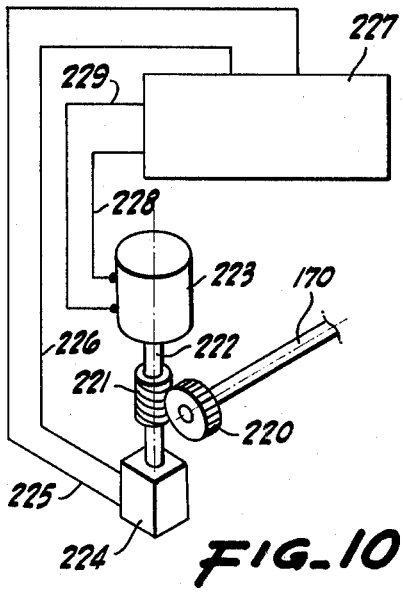
FIG. 10 is a diagrammatic view of a control mechanism for operating the control shaft which varies and determines the position and angle of the swash plate.

Referring now to FIG. 10, one of a number of suitable control systems for the control shaft 170 is shown. To the shaft 170 is fixed a worm wheel 220 meshing with a worm 221 fixed to a shaft 222 driven by a motor 223, which may be an electric motor as shown, or which may be an hydraulic motor. The shaft 222 extends into a control box 224. The control box 224 may contain equipment of known type which requires no detailed description herein except to note that it may include a threaded end to the shaft 222 and limit switch which are actuated to open and close circuits of a nut threaded onto the threaded end of the shaft 222. Wires 225 and 226, a solid state circuit element 227 and wires 228 and 229 are shown. Several suitable means are available for tying into, for example, the accelerator pedal of an automobile. As stated, an hydraulic motor may be used instead of an electric motor and the control may be taken mechanically off of the drive shaft.

It will, therefore, be apparent that a novel and advantageous reciprocating piston machine has been provided in which displacement and/or compression ratio can be changed and controlled at will. The machine embodies advantageous features such as relatively inexpensive manufacture of components which are not available off the shelf; ease of assembly, disassembly and adjustment; matching of counteracting forces; resistance to stress; economy with respect to size, etc.

I claim:

1. In a machine having a reciprocating piston-drive shaft-swash plate construction wherein reciprocating motion of the piston is translated into rotary motion of the drive shaft or vice versa, said swash plate being mounted coaxially on the drive shaft and at an angle to a plane perpendicular to the axis of the drive shaft, the improvement which comprises:

a. a stationary linear guide fixed to the frame,
b. linking means between the free end of the piston rod and the linear guide, said linking means acting to confine the piston rod to linear movement and being connected at one end to the free end of the piston rod,
c. said swash plate being formed with a circular circumferential groove concentric to the drive shaft,
d. a slide member slideable in said groove and
e. means connecting said slide member to the other end of said linkage.

2. The engine of claim 1 wherein said linkage comprises a slide slideable on said guide, a U-shaped member having two ends and a mid-portion, one such end portion being connected to the free end of the piston, the mid-portion being connected by a pair of spaced pins to said slide member, the other end portion being connected to the said slide member.

3. The engine of claim 1 wherein the connection of said linkage to the free end of the piston rod is in the form of a socket formed in the adjacent end of the linkage, a flange on the free end of the piston rod which is slideable in said socket, a closure for the socket acting to confine the flange within said socket and resilient means on opposite sides of said flange which allow small lateral movements of the piston rod in response to lateral forces caused by misalignment.

4. The improvement of claim 1 wherein said control means comprises a control shaft coaxial to the drive shaft, a differential gear assembly including a first gear affixed to and rotating with said control screw, a second gear affixed to and rotating with said control shaft, and gear means interconnecting said first and second gears whereby rotation of said second gear is imparted to said first gear to rotate said control screw relatively to the drive shaft.

5. In a drive shaft-cam shaft-swash plate combination for a multi-cylinder barrel type internal combustion reciprocating piston engine wherein reciprocating motion of the piston is converted by the swash plate to rotary motion of the drive shaft, the axial position of the swash plate on and its angle to the drive shaft determines the piston stroke and compression ratio and the swash plate is mounted on the drive shaft for rotation with the drive shaft, for variation of its angle to the drive shaft and for movement along the drive shaft, the improvement which comprises:

a. a hollow drive shaft, b. a hollow cam shaft concentric to the drive shaft and spaced from one end of the drive shaft,
c. a control screw within and concentric to the drive shaft and which rotates with the drive shaft,
d. means interconnecting the control screw and swash plate whereby, when the control screw is rotated relatively to the drive shaft the swash plate is shifted axially of the drive shaft,
e. means connecting opposing ends of the cam shaft and drive shaft to rotate the two together,
f. a control shaft mounted within and coaxially of the cam shaft for rotation independently of the cam shaft, and
g. means connecting opposing ends of the control shaft and control screw whereby when the control shaft is rotated with respect to the control screw an increment of rotation is added to or subtracted from rotation of the control screw relatively to the drive shaft.

6. The improvement of claim 5 wherein the connection between the drive shaft and cam shaft and between the control screw and control shaft comprises:
a. a housing including a ring gear, a sun gear fixed to the adjacent end of the drive shaft, and planet gearing connecting the sun gear and ring gear, said housing being fixed to the cam shaft, and
b. differential gears including a first gear fixed to the adjacent end of the control screw, a second gear fixed to the adjacent end of the control shaft and intermediate gear means whereby, when the control shaft and said second gear are rotated, said first gear and the control screw are rotated.

7. In a reciprocating piston-rotary drive shaft-swash plate machine wherein translation of reciprocating motion of the piston to rotary motion of the drive shaft and vice versa is caused by a swash plate mounted on and rotating with the drive shaft at an angle to a plane perpendicular to the axis of the drive shaft together with means inter-connecting the free end of the piston with the swash plate whereby reciprocation of the piston and rotation of the drive shaft are caused, the improvement which comprises:
a. a drive shaft having an axial passage therein,
b. means mounting the swash plate on the drive shaft for pivoting about an axis perpendicular to the axis of the drive shaft and for movement along the drive shaft,
c. a control screw located within the axial passage of the drive shaft and coaxially to the drive shaft,
d. means mounting such screw within such passage for rotation during steady state in the same direction as and at the speed of the drive shaft,
e. screw means connecting the pivotal mounting of the swash plate and said control screw whereby when the control screw is rotated relatively to the drive shaft the position of the swash plate on the drive shaft is varied, and
f. control means external to the drive shaft for so operating said control screw.

8. In a reciprocating piston engine comprising a frame, at least one cylinder, a piston reciprocable in the cylinder, a piston rod reciprocated by the piston, a drive shaft substantially parallel to the cylinder and rotated by or causing reciprocation of said piston and means operatively connecting the piston rod and the shaft for converting reciprocating motion of the piston into rotary motion of the shaft or vice versa, the improvement which comprises:
a. a crosshead connected to the free end of the piston rod,
b. a guide fixed to the frame acting to guide the crosshead for linear reciprocating motion substantially coaxial to the cylinder,
c. a swash plate mounted on the drive shaft for rotation therewith and at an angle to a plane perpendicular to the axis of the shaft,
d. means interconnecting the crosshead and the swash plate whereby reciprocating motion of the piston is translated into rotation of the drive shaft and vice versa,
e. means for adjusting the angle of the swash plate in relation to said perpendicular plane to vary the stroke of the piston or for adjusting the axial position of the swash plate on the drive shaft to control the compression ratio, or for both such purposes,
f. said crosshead comprising a first part and a second part, the first part being in the form of a bracket having a first leg connected to the free end of the piston rod and a second leg connected to the swash plate,
   i. the second part of the crosshead having a slot engaging said guide and slidable along the guide
   ii. said bracket and slotted part being interconnected by a pair of pins each passing through the bracket and the second part, one of said pins being closer to and the other of said pins being further from the piston rod.

9. A multi-cylinder internal combustion engine of the reciprocating piston type comprising:
a. a stationary frame,
b. a central drive shaft having an axial passage therethrough and rotatable in such frame,
c. a plurality of cylinders mounted on the frame equiangularly about the drive shaft and substantially parallel to the axis of the drive shaft,
d. a piston and piston rod reciprocable in each cylinder,
e. slide means including a stationary guide fixed to the frame for restricting each piston rod to linear motion,
f. a plate mounted on, concentric to and rotating with the drive shaft and having a circumferential guide track, said plate being formed with a central opening through which the drive shaft passes,
g. a pin bridging such opening, secured at its ends to the plate on opposite sides of the opening and passing through the drive shaft,
h. a screw located within the passage in the drive shaft and coaxially to the drive shaft, together with cooperative screw means effective when said control screw is rotated relatively to the drive shaft to move the plate axially of the drive shaft,
i. means responsive to such movement of the plate to cause the angle of the plate to vary as its axial position on the drive shaft is varied, and
j. means connecting each slide means with the guide track whereby reciprocating motion of the piston is translated into rotary motion of the drive shaft.

10. In a reciprocating piston engine having at least one cylinder, a piston reciprocable in the cylinder, a drive shaft, a swash plate mounted concentrically to the drive shaft for rotation with the drive shaft and for movement along the drive shaft to control the compression ratio and for pivoting about a pivot axis perpendicular to the drive shaft to vary the piston stroke, and means interconnecting the piston and the swash plate whereby rotation of the drive shaft causes reciprocation of the piston and vice versa, the improvement which comprises counterbalance means for counterbalancing reciprocating forces, said counterbalance means including a balance plate mounted to pivot about an axis which is parallel to and at a fixed distance from the pivot axis of the swash plate, and means whereby, as the axial position and the angle of the swash plate relatively to the drive shaft vary, the angle of the counterbalance means to the swash plate also varies and in a manner to counterbalance said reciprocating forces.

11. In a reciprocating piston engine comprising a frame, at least one cylinder, a piston reciprocable in the cylinder, a piston rod reciprocated by the piston, a drive shaft substantially parallel to the cylinder and rotated by or causing reciprocation of said piston and means operatively connecting the piston rod and the shaft for converting reciprocating motion of the piston into rotary motion of the shaft or vice versa, the improvement which comprises:

a. a crosshead connected to the free end of the piston rod, b. a guide fixed to the frame acting to guide the crosshead for linear reciprocating motion substantially coaxial to the cylinder, c. a swash plate mounted on the drive shaft for rotation therewith and at an angle to a plane perpendicular to the axis of the shaft, d. means interconnecting the crosshead and the swash plate whereby reciprocating motion of the piston is translated into rotation of the drive shaft and vice versa, e. means for adjusting the angle of the swash plate in relation to said perpendicular plane to vary the stroke of the piston or for adjusting the axial position of the swash plate on the drive shaft to control the compression ratio, or for both such purposes, and f. a balancing mass connected to the swash plate by means whereby its angular relation to the swash plate varies as the angle of the swash plate varies in relation to the drive shaft and in such manner as to match the combined moments of the swash plate and balancing mass with the reciprocating forces whereby at any desired angle and axial position of the swash plate the reciprocating forces of the engine are balanced.

12. A multi-cylinder internal combustion engine of the reciprocating piston type comprising:

a. a stationary frame, b. a central drive shaft having an axial passage therethrough and rotatable in same frame, c. a plurality of cylinders mounted on the frame equiangularly about the drive shaft and substantially parallel to the axis of the drive shaft, d. a piston and piston rod reciprocable in each cylinder, e. slide means including a stationary guide fixed to the frame for restricting each piston rod to linear motion, f. a circular plate mounted on, rotating with and concentric to the drive shaft by means allowing both adjustment of the angle of the plate in relation to a plane perpendicular to the axis of the drive shaft and for movement of the plate along the axis of the drive shaft so as to vary both the angle of the plate in relation to the drive shaft and the position of the plate relative to the axis of the drive shaft, said plate also having a circumferential circular guide track, g. means within the passage of the drive shaft for moving the plate axially of the drive shaft, h. means responsive to such movement of the plate to cause the angle of the plate to vary as its axial position on the drive shaft is varied, i. means connecting each slide means with the guide track whereby reciprocating motion of the piston is translated into rotary motion of the drive shaft, and j. a balance plate connected to the first mentioned plate by means acting in response to the angle of the first mentioned plate in relation to the drive shaft to maintain at any desired axial and angular position of the first mentioned plate a balance to reciprocating forces.

* * * * *